US010151166B2

(12) United States Patent
Mathis

(10) Patent No.: US 10,151,166 B2
(45) Date of Patent: Dec. 11, 2018

(54) WELL HEAD STABILIZING DEVICE AND METHOD

(71) Applicant: NeoDrill AS, Ålgård (NO)

(72) Inventor: Wolfgang Mathis, Sandnes (NO)

(73) Assignee: NeoDrill AS, Ålgård (NO)

( * ) Notice: Subject to any disclaimer, the term of this patent is extended or adjusted under 35 U.S.C. 154(b) by 99 days.

(21) Appl. No.: 15/234,344

(22) PCT Filed: Feb. 18, 2015

(86) PCT No.: PCT/NO2015/050034
§ 371 (c)(1),
(2) Date: Aug. 11, 2016

(87) PCT Pub. No.: WO2015/126259
PCT Pub. Date: Aug. 27, 2015

(65) Prior Publication Data

US 2017/0183934 A1 Jun. 29, 2017

(30) Foreign Application Priority Data

Feb. 18, 2014 (NO) ..... 20140210

(51) Int. Cl.
*E21B 33/037* (2006.01)
*E21B 33/035* (2006.01)
*E02D 27/52* (2006.01)

(52) U.S. Cl.
CPC ..... *E21B 33/037* (2013.01); *E02D 27/52* (2013.01); *E21B 33/035* (2013.01)

(58) Field of Classification Search
CPC .... E21B 33/037; E21B 33/14; E21B 47/0005; E02D 27/52
See application file for complete search history.

(56) References Cited

U.S. PATENT DOCUMENTS 3,063,500 A * 11/1962 Logan ..... E21B 33/037 166/351
3,352,357 A * 11/1967 Van Eek ..... E21B 17/01 166/355

(Continued)

FOREIGN PATENT DOCUMENTS

CN 2189200 Y 2/1995
CN 1118616 3/1996

(Continued)

OTHER PUBLICATIONS

Norwegian Search Report, Patent Application No. 20140210, dated Sep. 18, 2014.

(Continued)

*Primary Examiner* — Matthew R Buck
*Assistant Examiner* — Aaron L Lembo
(74) *Attorney, Agent, or Firm* — Andrus Intellectual Property Law, LLP

(57) ABSTRACT

A device is for stabilizing a well head which includes a well base arranged on a seabed. The well base includes at least a support column, and a first portion of a conductor casing being encircled by the support column, an annulus encircling the first conductor-casing portion being filled with cement, and a second portion of the conductor casing projecting in an elastically flexible manner up from the first conductor-casing portion. A method is for stabilizing a well head which includes a well base arranged on a seabed.

20 Claims, 2 Drawing Sheets

(56) References Cited

U.S. PATENT DOCUMENTS

| | | | | |
|---|---|---|---|---|
| 3,561,531 | A | 2/1971 | Miller | |
| 3,563,313 | A * | 2/1971 | Spangle | C04B 7/00 166/292 |
| 4,240,506 | A * | 12/1980 | Dareing | E21B 7/128 166/367 |
| 4,499,950 | A | 2/1985 | Watkins | |
| 4,949,788 | A | 8/1990 | Szarka et al. | |
| 5,343,951 | A | 9/1994 | Cowan et al. | |
| 5,435,386 | A * | 7/1995 | LaFleur | E21B 33/16 166/156 |
| 5,927,403 | A | 7/1999 | Dallas | |
| 7,270,183 | B2 * | 9/2007 | Bour | C04B 28/02 106/672 |
| 8,517,111 | B2 * | 8/2013 | Mix | E21B 21/08 166/250.01 |
| 9,109,725 | B2 * | 8/2015 | Maher, IV | B63B 35/44 |
| 9,518,443 | B2 * | 12/2016 | Tunget | E21B 23/14 |
| 2003/0029620 | A1 | 2/2003 | Strand | |
| 2011/0178730 | A1 * | 7/2011 | Mangal | E21B 17/017 702/43 |

FOREIGN PATENT DOCUMENTS

| | | |
|---|---|---|
| CN | 101061291 | 10/2007 |
| CN | 102234999 | 11/2011 |
| GB | 2198768 | 6/1988 |
| NO | 313340 | 8/2001 |

OTHER PUBLICATIONS

International Search Report, PCT/NO2015/050034, dated May 11, 2015.

International Written Opinion, PCT/NO2015/050034, dated May 11, 2015.

* cited by examiner

WELL HEAD STABILIZING DEVICE AND METHOD

FIELD

The invention relates to a device and a method for stabilizing a well head which includes a well base arranged on a seabed.

BACKGROUND

When a subsea well for extracting petroleum, for example, is established, a well-foundation system is installed on the seabed. A conventional base is usually established by a hole being drilled in the seabed (usually 36" or 42"), in which a conductor casing (usually 30" or 36") is lowered into and fixed in the unconsolidated masses by a cement slurry being pumped in for the purpose of completely filling the space between the conductor casing and the hole wall. Thereby it is sought to achieve two primary aims:

1) the cured cement is to give full lateral support to the conductor casing up to the seabed, and 2) the cured cement is to give enough cover and strength for the first coupling of the conductor casing to be fully embedded and protected from any movements transmitted from a connected riser system to the conductor casing.

It turns out in practice that loss of cement slurry into, above all, permeable layers of unconsolidated mass may occur, and the conductor casing may move during the curing of the cement. This leads to the cement having a reduced quality, and it leads to the stiffness of the conductor casing being reduced to such a degree that specific design requirements are not reached, with the consequence that the fatigue strength of the well will be too low or that the load capacity of the well will not be fulfilled.

SUMMARY

The invention has for its object to remedy or reduce at least one of the drawbacks of the prior art or at least provide a useful alternative to the prior art.

The object is achieved through features, which are specified in the description below and in the claims that follow.

A well-foundation system for a subsea well for the production of petroleum, for example, is provided. A support column is set into an unconsolidated mass below a sea floor and forms a reliable mounting for a conductor casing so that a structure, which is predictable and as reliable as possible with respect to the stability and load capacity of a well head is provided through a direct coupling between the unconsolidated mass, the support column and the conductor casing of the well. The support column is driven down into the unconsolidated mass with a jacket surface in direct contact with the unconsolidated mass without any predrilling of holes or use of cement or other fillers, for example by the use of a suction base, for example a so-called CAN (Conductor Anchor Node) according to the applicant's own NO patent No. 313340, or other methods. Then the conductor casing is installed through the support column in a manner known per se, for example by a hole being drilled into the unconsolidated mass into which the conductor casing is lowered. The conductor casing is fixed and supported in the support column. Thereby a predetermined and controlled hanging-off of the conductor casing, an accurate positioning of the attachment point of the conductor casing, that is to say the transition between a supported portion and a freely flexible portion of the conductor casing, and full cementing of the conductor casing in the support column below said attachment point are achieved.

The support column can be driven down into the unconsolidated mass, for example as an integral part of a suction base, that is to say a suction base with a closed top and an open bottom, in which an underpressure is worked up inside the well base by water mass enclosed by the well base and the seabed being pumped out, so that the downward resultant force arising on the well base through said underpressure is used to press the suction base and the support column down into the unconsolidated mass. Thereby the support column is positioned in good contact with the unconsolidated mass over its entire length and forms a reliable lateral and vertical support for the conductor casing during the subsequent installation of the conductor casing in the support column.

The support column may also be driven down into the unconsolidated mass by means other than the suction base as described above, for example by it being driven in by means of a hammer, and it may be part of a well frame or other supporting structure, which is anchored to the seabed with one or more suction anchors.

The task of the support column is to provide a continuous contact surface against the unconsolidated mass without the use of cement or other types of filler or grouting material between the unconsolidated mass and the jacket surface of the support column, so that a planned and checkable stability and a well-defined interface against the unconsolidated mass are achieved.

The support column may form a seat for the conductor casing, as the conductor casing is passed through the former and hung off by means of suitable means, for example a suspension clamp, with a prescribed length projecting freely above the seabed. The conductor casing may then be cemented into the support column and, in a manner known per se, against the unconsolidated mass below the support column up to a prescribed level in the support column, so that the conductor casing will have an optimum free top length (for example in the range of 2-5 meters) with respect to fatigue and allowed distance of deflection. Primarily, the upper cement level is governed by the vertical positioning of a cement-diversion system arranged in the support column, alternatively by cement being flushed out of the annulus between the support column and the conductor casing until a prescribed upper cement level has been provided. To achieve an even and continuous filling of the annulus, the support column may be provided with a system for separately introducing cement or other grouting material from a lower level in the support column up to the chosen level of attachment of the conductor casing.

Advantageously, one or more centring means may be arranged between the support column and the conductor casing optimally placed for an exact definition of the attachment of the conductor casing to the support column.

In an alternative embodiment, the planned free conductor-casing length in the support column may have a coating of a suitable elastomer material in a prescribed, optimized thickness applied to it. In this embodiment, the conductor casing is cemented with a full cement filling to the top of the support column. After the cement has cured, this elastomer material will give the conductor casing the free conductor-casing length chosen in advance. A further effect of the elastomer material may be a damping of any potential large single swings resulting from lateral forces imposed through the riser system.

The invention is defined by the independent claims. The dependent claims define advantageous embodiments of the invention.

In a first aspect, the invention relates more specifically to a device for stabilizing a well head including a well base arranged on a seabed, characterized by the well base including at least a support column, and a first portion of a conductor casing being encircled by the support column, an annulus encircling the first conductor-casing portion being filled with cement, and a second portion of the conductor casing projecting in an elastically flexible manner up from the first conductor-casing portion.

At the transition between the first and second conductor-casing portions, the annulus may be provided with a packer downstream of a cement-diversion system, which is arranged to carry any excess of cement away from the annulus.

The jacket surface of the second conductor-casing portion may be provided with an elastomer coating extending from the transition to the first conductor-casing portion and at least to the upper edge of the upper portion of the well base, and at least a portion of the elastomer coating is surrounded by cement.

The support column may be provided with a flushing line which discharges into the annulus at the level of the transition between the first and second conductor-casing portions.

The support column may be provided with a cementing line, which discharges into a lower portion of the annulus between the support column and the conductor casing.

In a substantial part of its longitudinal extent, the support column may rest in a laterally supporting manner against an unconsolidated mass.

A third conductor-casing portion may extend downwards in an unconsolidated mass below the support column.

The conductor casing may extend upwards from a conductor-casing attachment, the conductor casing and a lower end portion of the support column being interconnected via the conductor-casing attachment.

In a second aspect, the invention relates more specifically to a method of stabilizing a well head which includes a well base arranged on a seabed, characterized by the method including the following steps:

- driving a support column down into an unconsolidated mass below the seabed;
- lowering a first portion of a conductor casing into the support column;
- filling an annulus which is formed between the support column and a first portion of the conductor casing with cement;
- letting a second portion of the conductor casing project above the support column; and
- establishing the well head on the second conductor-casing portion projecting upwards.

The method may further include the step:

- limiting the annulus with a packer at the transition between the first and second conductor-casing portions.

The method may further include the step:

- filling the annulus by letting the cement enter a lower portion of the support column.

The method may further include the steps:

- limiting the annulus with a packer at the transition between the first and second conductor-casing portions;
- filling the annulus by letting the cement enter a lower portion of the support column; and
- carrying an excess amount of cement out of the annulus through a cement-diversion system arranged at the lower edge of the packer.

The method may further include:

- flushing an excess amount of cement out of the annulus by means of a flushing line discharging into the annulus at the level of the transition between the first and second conductor-casing portions.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 2:
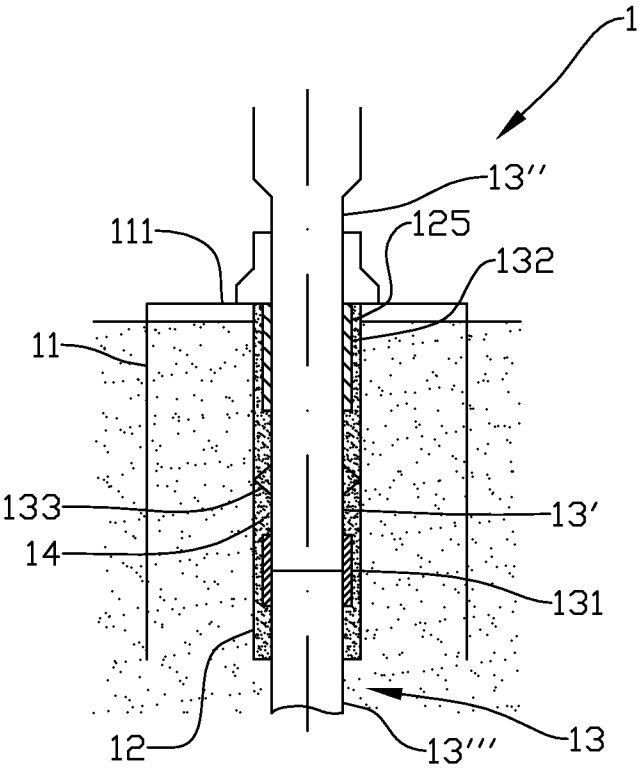
FIG. 2 shows, in an axial section, a principle drawing of the conductor casing of a petroleum well supported by a support column integrated in a suction base driven down into seabed sediments, the attachment point of the conductor casing being determined by the use of an elastomer material over a length which gives the desired free mounting length of the conductor casing.

In the figures, the reference numeral 1 indicated a well head arranged on a seabed 21 over a layer of unconsolidated mass 2. In a well base 11, which, in its simplest embodiment, may be a support column 12 driven down into the unconsolidated mass, but which is shown in the figures as a suction base which is driven down, together with an integrated support column 12, into the unconsolidated mass 2, the support column 12 being arranged for the support and hanging-off of a conductor casing 13 extending downwards in the unconsolidated mass 2 in a manner known per se. The conductor casing 13 may be placed in the unconsolidated mass 2 in any known way. The conductor casing 13 may be sectioned and may thereby include several conductor-casing joints 131 in a manner known per se, only one shown in FIGS. 1-3. Centring means 133 may provide for the conductor casing 13 to be centred in the support column 12.

Figure 1:
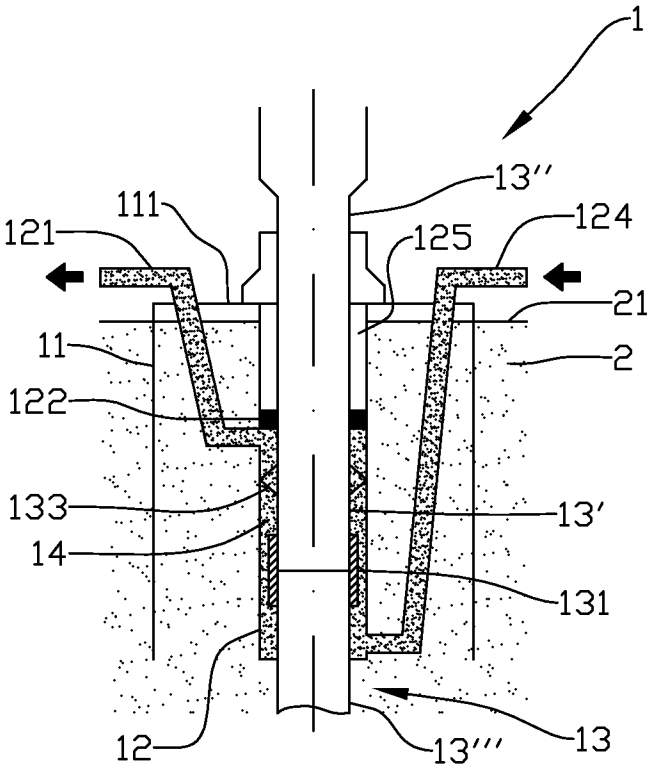
FIG. 1 shows, in an axial section, a principle drawing of the conductor casing of a petroleum well supported by a support column integrated in a suction base driven down into seabed sediments, the attachment point of the conductor casing being determined by the use of a packer and a diversion system for cement.

In an annulus 125 between the support column 12 and a first portion 13' of the conductor casing 13, cement 14 has been introduced. The cement 14 may have been injected separately into the annulus 125 through a cementing line 124 as it is shown in FIG. 1. A third portion 13''' of the conductor casing 13 may extend downwards in the unconsolidated mass 2 under the support column 12 and may, if necessary, be surrounded by cement (not shown) filling up cavities between the third portion 13''' of the conductor casing 13 and the unconsolidated mass 2. In this embodiment, the cement 14 may be carried up the annulus in the support column 12 while the third conductor-casing portion 13''' is being cemented into the unconsolidated mass 2.

In FIG. 1, a packer 122 prevents the cement 14 from flowing up the annulus 125 between the support column 12 and a second conductor-casing portion 13" projecting freely up through an upper portion of the support column 12 and up above an upper portion 111 of the well base 11. The packer 122 is placed at a distance below the top surface 111 for the cement 14 to form a lateral support for the conductor casing 13 at a prescribed distance below the well head 1. In this embodiment, a sufficient filling of the annulus 125 will be ensured by excess cement being allowed to leave the annulus 125 through a cement-diversion system 121, which also functions as a diversion system for water et cetera which is driven up through the annulus 125 in front of the cement 14. The cement-diversion system 121 may include means, not shown, for regulating the level of the cement 14 in the annulus 125, for example a pump. The length of the second conductor-casing portion 13" and the positioning of the packer 122 are determined on the basis of the requirements for the length of deflection of the conductor casing 13, which is typically in the range of 2-6 meters.

FIG. 2 shows a second exemplary embodiment, in which parts of the jacket surface of the second conductor-casing portion 13" is covered by an elastomer coating 132. The elastomer coating 132 extends from an upper edge of the upper portion 111 of the well base 11 to a prescribed distance below the upper portion 111. In this embodiment, cement 14 is filled to the top of the support column 12. The elastomer coating 132, which is yielding, will thereby allow the second conductor-casing portion 13" to deflect laterally corresponding to the exemplary embodiment shown in FIG. 1.

Figure 3:
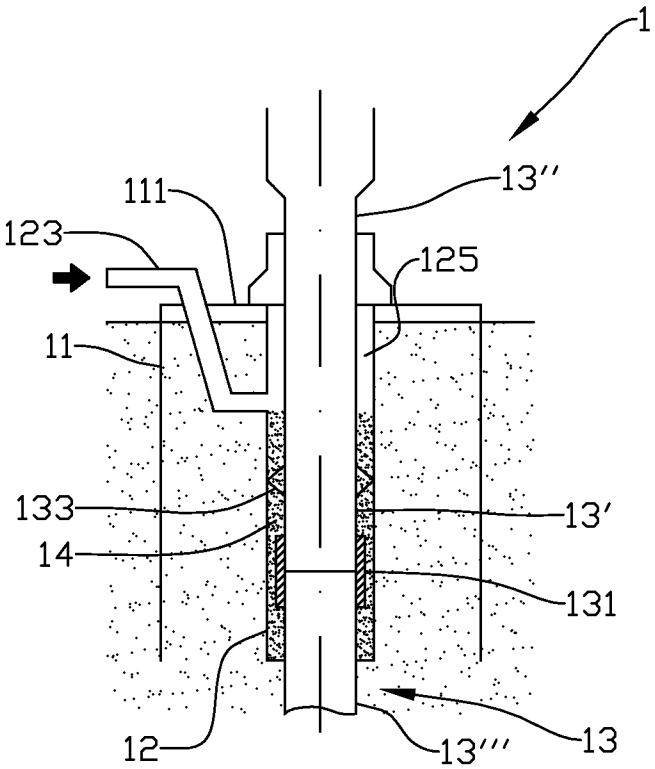
FIG. 3 shows, in an axial section, a principle drawing of the conductor casing of a petroleum well supported by a support column integrated in a suction base driven down into seabed sediments, the attachment point of the conductor casing being determined by the flushing-out of injected cement above a level which gives the prescribed free mounting length of the conductor casing.

FIG. 3 shows a third exemplary embodiment, in which a flushing line 123 discharges into the support column 12 at a distance below the upper portion 111 of the well base 11. Excess cement 14 is flushed out of the annulus 125 so that the second conductor-casing portion 13" stands freely in the support column 12 to be able to deflect side-ways corresponding to the exemplary embodiment shown in FIG. 1.

Figure 4:
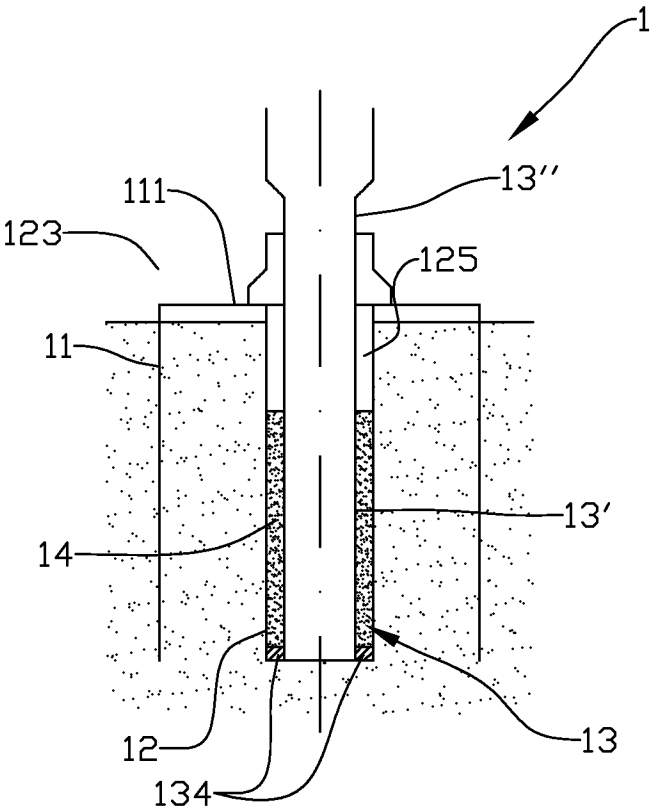
FIG. 4 shows, in an axial section, a principle drawing of a shorter conductor casing fixed in a lower portion of a support column integrated in a suction base driven down into seabed sediments, the upper attachment point of the conductor casing being determined by a controlled filling of cement to a level arranged to give the prescribed free mounting length of the conductor casing, the conductor casing being fixed to the support column before the base is put down on the seabed.

FIG. 4 shows a fourth exemplary embodiment, in which a short conductor casing 13 is attached to a lower portion of the support column 12 by means of a conductor-casing attachment 134, and in which cement 14 has been filled into the annulus 125 to a prescribed level based on the requirements for the length of deflection of the conductor casing 13. The advantage of this embodiment is that the joining of the conductor casing 13 and the support column 12 and the filling of cement 14 into the annulus 125 can be carried out before the assembly is placed on the seabed 21 and driven down into the unconsolidated mass 2, for example at an onshore facility, before the assembly is transported to the location where the well head 1 is to be established.

With its embodiments, the invention provides a system for a predetermined fixing of the conductor casing 13 of a subsea well head 1 into the surrounding unconsolidated masses 2, it being possible to give the conductor casing 13 a controllable attachment point, preferably placed below the seabed 21, so that the conductor casing 13 will be arranged with a predetermined free length of the second conductor-casing portion 13" for optimum utilization of the elastic properties of the conductor casing 13 in a calculated, reliable way.

The support column 12 is forced down into the unconsolidated mass 2 below the seabed 21 and given stable lateral support in the unconsolidated mass 2 as a well base 11 alone or part of a more complex well base 11.

By providing the conductor casing 13 with a suspension device, not shown, for vertical support in the support column 12 or the well base 11, the conductor casing 13 according to the exemplary embodiments of FIGS. 1-3 may be disconnected from a pipe-landing string, not shown, while the cement is curing. Thereby the best possible conditions are provided for developing full cement strength without breaking cement bindings, by the conductor casing 13 not being subjected to movements during the setting and initial curing of the cement 14.

A further advantage of the invention is that the support column 12 forms a barrier between the cement 14 and the unconsolidated mass 2 during the introduction of the cement 14, so that the cementing of the first conductor-casing portion 13' may take place under near-ideal conditions and full cement strength be achieved after curing and planned stability be achieved for both the conductor casing 13 in general and the conductor-casing joint 131 in particular.

The invention claimed is:

1. A device for stabilizing a well head on a sea bed, the device comprising:

a well base having a suction base and a support column formed integrally with the suction base, and a conductor casing having a first portion that is encircled by the support column and a second portion that projects upwardly from the first portion, wherein an annulus is defined between the support column and the conductor casing, the annulus having a lower portion that encircles the first portion of the conductor casing and is filled with cement, and an upper portion that encircles the second portion of the conductor casing and is free from cement such that the second portion of the conductor casing is elastically flexible with respect to the first portion.

2. The device according to claim 1, wherein the suction base has a closed top and an open bottom, and wherein an underpressure is worked up inside the well base by a water mass enclosed by the well base and the sea bed so that a downward resultant force arises on the well base from the underpressure, which presses the suction base and support column down into an unconsolidated mass below the sea bed.

3. The device according to claim 2, wherein the lower portion of the support column rests in a laterally supporting manner against the unconsolidated mass.

4. The device according to claim 3, wherein the support column has a continuous contact surface against the unconsolidated mass without any material between the unconsolidated mass and the continuous contact surface.

5. The device according to claim 4, further comprising a cementing line that supplies the cement into the annulus along the first portion of the conductor casing.

6. The device according to claim 5, further comprising a pump that regulates a level of the cement in the annulus.

7. A device for stabilizing a well head on a sea bed, the device comprising:

a well base having a support column;

a conductor casing having a first portion that is encircled by the support column and a second portion that projects upwardly from the first portion, wherein an annulus is defined between the support column and the conductor casing, the annulus having a lower portion that encircles the first portion of the conductor casing and is filled with cement, and an upper portion that encircles the second portion of the conductor casing and is free from cement such that the second portion of the conductor casing is elastically flexible with respect to the first portion;

a packer disposed in the annulus at a distance below a top surface of the sea bed and above the second portion of the conductor casing, wherein the packer prevents cement from flowing up to the top surface via the annulus between the support column and the second portion of the conductor casing; and a cement-diversion system connected to the annulus below the packer and configured to carry away an excess of the cement from the annulus below the packer as the cement fills up the annulus between the support column and the first portion of the conductor casing.

8. The device according to claim 7, wherein the lower portion of the support column rests in a laterally supporting manner against an unconsolidated mass below the sea bed.

9. The device according to claim 8, wherein the support column has a continuous contact surface against the unconsolidated mass without any material between the unconsolidated mass and the continuous contact surface.

10. The device according to claim 9, further comprising a cementing line that supplies the cement into the annulus along the first portion of the conductor casing.

11. The device according to claim 10, further comprising a pump that regulates a level of the cement in the annulus.

12. The device according to claim 11, wherein the conductor casing has a third portion that extends downwardly below the support column into the unconsolidated mass.

13. A device for stabilizing a well head on a sea bed, the device comprising:

a well base having a support column;

a conductor casing having a first portion that is encircled by the support column and a second portion that projects upwardly from the first portion, wherein an annulus is defined between the support column and the conductor casing, the annulus having a lower portion that encircles the first portion of the conductor casing and is filled with cement, and an upper portion that encircles the second portion of the conductor casing and is free from cement such that the second portion of the conductor casing is elastically flexible with respect to the first portion; and a flushing line that flushes the annulus below an uppermost portion of the well base, wherein the flushing line is configured to flush excess cement upwardly out of the annulus alongside the second portion of the conductor casing, while leaving the cement in the annulus alongside the first portion of the conductor casing.

14. The device according to claim 13, wherein the lower portion of the support column rests in a laterally supporting manner against an unconsolidated mass below the sea bed.

15. The device according to claim 14, wherein the support column has a continuous contact surface against the unconsolidated mass without any material between the unconsolidated mass and the continuous contact surface.

16. A method of establishing a well head which includes a well base arranged on a sea bed, the method comprising:

providing a well base having an integrated suction base and support column;

placing the well base on the sea bed and creating an underpressure inside the well base so that a downward resultant force arises on the well base, which presses the suction base and support column down into an unconsolidated mass below the sea bed;

lowering a first portion of a conductor casing into the support column;

filling an annulus between the support column and the first portion of the conductor casing with cement;

providing a second portion of the conductor casing that projects above the support column such that an annulus between the second portion of the conductor casing remains free from cement; and establishing the well head on the second portion of the conductor casing.

17. A method of establishing a well head which includes a well base arranged on a seabed, the method comprising:

driving a support column down into an unconsolidated mass below the seabed;

lowering a first portion of a conductor casing into the support column;

providing a second portion of the conductor casing that projects above the support column;

installing a packer in an annulus between the support column and the conductor casing, the packer being located at a transition between the first and second portions of the conductor casing;

filling the annulus between the support column and the first portion of the conductor casing with cement and such that the packer causes the second portion of the conductor casing to remain free from cement; and establishing the well head on the second portion of the conductor casing.

18. The method according to claim 17, further comprising filling the annulus along the support column and the first portion of the conductor casing by causing the cement to enter a lower portion of the support column.

19. The method according to claim 18, further comprising diverting an excess amount of cement out of the annulus along the first portion of the conductor casing through a cement-diversion system connected to the annulus below the packer.

20. A method of establishing a well head which includes a well base arranged on a seabed, the method comprising:

driving a support column down into an unconsolidated mass below the seabed;

lowering a first portion of a conductor casing into the support column;

filling an annulus between the support column and the first portion of the conductor casing with cement;

providing a second portion of the conductor casing that projects above the support column such that an annulus between the second portion of the conductor casing remains free from cement;

flushing an excess of cement upwardly out of the annulus alongside the second portion of the conductor casing, leaving a remaining amount of cement in the annulus alongside the first portion of the conductor casing; and establishing the well head on the second portion of the conductor casing.

* * * * *